US010946393B2

(12) United States Patent
Corona et al.

(10) Patent No.: US 10,946,393 B2
(45) Date of Patent: Mar. 16, 2021

(54) MULTI-NOZZLE MULTI-CONTAINER FLUID SPRAY DEVICE

(71) Applicants: Marene Corona, West Jordan, UT (US); Cameron H. Gardener, Sandy, UT (US)

(72) Inventors: Marene Corona, West Jordan, UT (US); Cameron H. Gardener, Sandy, UT (US)

( * ) Notice: Subject to any disclaimer, the term of this patent is extended or adjusted under 35 U.S.C. 154(b) by 0 days.

(21) Appl. No.: 16/681,633

(22) Filed: Nov. 12, 2019

(65) Prior Publication Data

US 2020/0078799 A1 Mar. 12, 2020

Related U.S. Application Data

(63) Continuation-in-part of application No. 16/228,743, filed on Dec. 20, 2018.

(60) Provisional application No. 62/610,930, filed on Dec. 28, 2017.

(51) Int. Cl.
*B05B 1/16* (2006.01)
*B05B 11/00* (2006.01)

(52) U.S. Cl.
CPC ..... *B05B 1/16* (2013.01); *B05B 11/0054* (2013.01); *B05B 11/3011* (2013.01); *B05B 11/3084* (2013.01)

(58) Field of Classification Search
CPC .. B05B 1/16; B05B 1/169; B05B 7/08; B05B 7/1209; B05B 7/1236; B05B 7/2405; B05B 7/2408; B05B 7/2416; B05B 7/2464; B05B 7/2472; B05B 11/0008; B05B 11/0054; B05B 11/3011; B05B 11/3043; B05B 11/3047; B05B 11/3083; B05B 11/3084
See application file for complete search history.

(56) References Cited

U.S. PATENT DOCUMENTS 5,152,431 A * 10/1992 Gardner ..... B05B 11/3081 222/136
5,152,461 A * 10/1992 Proctor ..... B05B 11/0064 239/304
5,683,014 A * 11/1997 Smolen, Jr. ..... B05B 11/3009 222/137
5,887,761 A * 3/1999 Foster ..... B05B 11/007 222/383.1
7,222,752 B2 * 5/2007 Ponton ..... B05B 11/3083 222/134
2004/0238567 A1 * 12/2004 Bloc ..... B05B 11/3084 222/135
2005/0092778 A1 * 5/2005 Bistolfi ..... B05B 1/341 222/383.1

(Continued)

*Primary Examiner* — Ryan A Reis
(74) *Attorney, Agent, or Firm* — Paul C. Oestreich; Eminent IP, P.C.

(57) ABSTRACT

The multi-nozzle multi-container fluid spray device includes multiple, for example, three, containers. Each container may hold a different liquid which the user may dispense individually. The containers are connected to each other and to a spray handle and spray head in a reversible manner. Multiple pumps and tubes may be housed within the spray head and one of multiple hoses may extend from each pump into one of the containers. Each pump is designed to dispense a liquid from one of the containers through a single nozzle end. Thus, a single spray bottle may individually dispense different solutions without mixing the solutions.

20 Claims, 15 Drawing Sheets

(56) References Cited

U.S. PATENT DOCUMENTS

| | | | | |
|---|---|---|---|---|
| 2010/0282776 | A1* | 11/2010 | Knopow | B67D 7/005<br>222/145.1 |
| 2011/0057054 | A1* | 3/2011 | Dessaint | B65D 81/3288<br>239/302 |
| 2018/0056312 | A1* | 3/2018 | Hou | B05B 15/70 |
| 2018/0361409 | A1* | 12/2018 | Beyda | B05B 11/0078 |

* cited by examiner

MULTI-NOZZLE MULTI-CONTAINER FLUID SPRAY DEVICE

RELATED APPLICATIONS

This application is a continuation in part of U.S. Non-provisional patent application Ser. No. 16/228,743, filed Dec. 20, 2018, which claims the benefit of U.S. Provisional Patent Application No. 62/610,930, filed Dec. 28, 2017, both of which are hereby incorporated by reference in their entirety.

BACKGROUND

Field of the Invention

This disclosure relates to fluid delivery devices and containers including fluid spray bottles.

BACKGROUND OF THE INVENTION

A variety of industries use bottles and other containers to store fluids and deliver them in the form of a spray nozzle or nebulizer. These industries include, but are not limited to, household cleaning, automotive, lawn and garden, medical, beauty and cosmetics, dental, and any market which utilizes trigger spray bottles.

Often tasks require multiple solutions requiring the user to manage multiple containers which may be inconvenient for the user. For example, a task may require the use of three different solutions which must be applied sequentially and possibly within a short time period of each other. In this scenario, the user must carry three separate bottles to the location where the task will be performed and move between the use of each bottle. A single container which could store, yet keep separate, the multiple solutions and deliver each separately or in a defined combination would be more convenient for the user.

In addition, the user must store three separate containers between uses. A single container which stores multiple fluids in separate compartments would require less storage space.

Furthermore, when multiple fluids are supplied in separate containers, each container results in a separate piece of waste in a landfill. A container which stores separate fluids in refillable compartments may reduce the amount of waste and negative impact on the environment.

BRIEF SUMMARY OF THE INVENTION

We disclose a multi-nozzle multi-container fluid spray device which includes a plurality of containers, each of which may each hold a different fluid. The multi-nozzle multi-container fluid spray device may include a single spray head with a single trigger in connection with a plurality of pumps. A hose may extend from each pump into one of a plurality of containers. The spray head may also include a plurality of nozzle ends. A tube may extend from each pump to one of a plurality of nozzle ends which may dispense fluid through one of a plurality of orifices in a fluid dispenser. In some embodiments, the plurality of each of these parts may be three of each part.

The plurality of pumps may be enclosed within a rotatable pump carriage which is in mechanical connection with a selector switch indicator. A user may move the selector switch indicator to one of a plurality of selector switch positions to select which container to access and, accordingly, which fluid to dispense. When the rotatable pump carriage moves the plurality of pumps, a single pump will be disposed in a position in which it is in mechanical connection with the single trigger. In some embodiments, this may be a center position in alignment with a fluid dispenser on the front of the spray head. A user may dispense the desired fluid from the desired container upon squeezing the trigger.

The multi-nozzle multi-container fluid spray device may include a container release device which may be reversibly connected to the top of each of the plurality of containers. The container release device may include a container release housing. The container release housing may include a plurality of walls which may partially define a plurality of orifices. A container may be inserted into each orifice. A lip may be disposed at the lower edge of each of the plurality of walls. A container may be inserted into each orifice and the lip may snap over the top of the container thereby holding the container in place. A release clip may also partially define each of the orifices. Each release clip may also snap over the top of one of the containers.

The container release device may also include a plurality of push buttons which may, in turn, be in mechanical connection with a plurality of release bars. Each of the plurality of release bars may be in mechanical connection with one of the plurality of release clips. In some embodiments, the container release device includes a spring-loaded mechanism. By pushing one of the push buttons, the release bar connected to it may, in turn, apply pressure to the adjacent release clip. The release bar may push the release clip outward, reversibly expanding the orifice. The container may slip out of the orifice and the release clip may return to its original position.

In some embodiments, the multi-nozzle multi-container fluid spray device is a triple-nozzle spray container. In an example, some embodiments include three containers. In an example, some embodiments include, three pumps, three hoses, and three nozzles. In an example, the container release mechanism includes three push buttons.

The plurality of containers may be reversibly connected to each other. For example, they may be interlocking through a mechanism which may include interlocking male and female notches. The opening of each of the containers may be covered by a seal. Each seal may comprise a hose receptacle through which one of the plurality of hoses may be reversibly inserted.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings.

DETAILED DESCRIPTION OF THE INVENTION

Definitions

Figure 1:
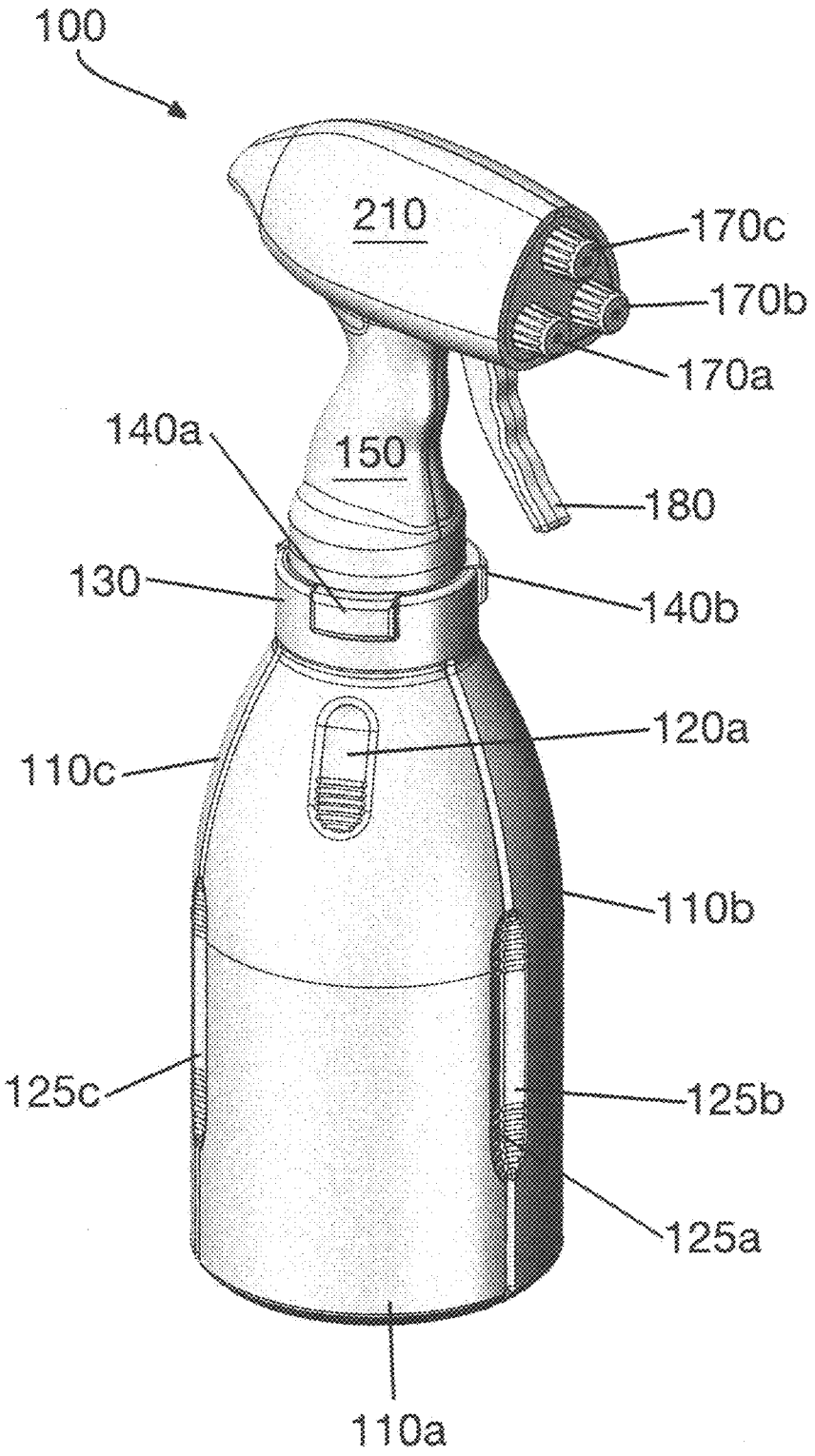
FIG. 1 is a perspective view of a multi-nozzle spray bottle according to an embodiment of the disclosure.

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

The disclosed multi-nozzle multi-container fluid spray device solves the problem of needing multiple containers of different liquid spray solutions by combining multiple containers into one device thus providing a flexible tool for the user. It also reduces waste which may fill landfills by providing a mechanism to refill each container. The disclosed multi-nozzle multi-container fluid spray device is also more convenient for the user and saves time, money, and resources.

The disclosed multi-nozzle multi-container fluid spray device includes multiple containers which may each hold a different liquid. The containers may be bottles, tubes, sleeves, flasks, jars, packets, cans, drums, or any container known in the art which may hold a liquid. In an example, the multi-nozzle multi-container fluid spray device includes two, three, four, five, or six containers.

Each of the multiple containers may be reversibly connected to another container. In the example in which the plurality of containers includes three containers, each container is reversibly connected to two other containers.

The multiple containers may be reversibly connected by being interlocking with each other. In an example, the containers may each include one or more male notches and one or more female notches. A male notch of one container may insert into the female notch of one or more adjacent containers.

Each of the containers may include a top rim which defines an opening. In some embodiments, the top rim of one or more of the containers is covered by a seal. Each seal may include a hose receptacle. The hose receptacles may be constructed of an easily perforated material through which the end of a hose extending from the spray head may extend. In an example, the hose receptacles may be constructed of foil, wax paper, or plastic.

The containers may be disposable, replaceable, or refillable. They may be constructed of a recyclable material. In some embodiments, the containers are constructed of glass, one or more plastic polymers, foil, recyclable material, biodegradable material, paper, wax paper, or hemp plastic.

In some embodiments, the containers include finger indentations onto which a user may place his or her finger to aid in gripping the multi-nozzle multi-container fluid spray device during use. Similarly, thumb indentations may be included on the containers. In some embodiments, the finger and thumb indentations include ridges to further improve gripping. The containers may have curved or custom-molded lines to fit into the user's hand comfortably during use.

The multi-nozzle multi-container fluid spray device may include a spray head which is in mechanical connection with each of the plurality of containers. In some embodiments, the spray head may include a plurality of nozzles. Some embodiments may include the same number of nozzles as containers. Other embodiments may include a single nozzle in fluid communication with a plurality of pumps. Each nozzle may be independently turned to an "off" position while the other nozzles may be open and available to dispense fluid. In some embodiments, each nozzle may be selected from the following list: a plain-orifice nozzle, a shaped-orifice nozzle, a surface-impingement single-fluid nozzle, a spiral spray nozzle, a pressure-swirl single-fluid spray nozzle, a spillback nozzle, and a solid-cone single-fluid nozzle. In some embodiments, one or more of the nozzles may be adjustable and able to deliver a range of densities of fluid particles by passing the fluid through a region of a mesh which includes different regions with different size pores.

In some embodiments the multiple nozzles may each be connected to a first side a front plate. A second side of the front plate may be mechanically connected to a plurality of pumps, each pump being a part of the spray head. In an example, the spray head may include two, three, four, five, or six pumps. In some embodiments, the pumps may be reciprocating piston pumps. Each of the pumps may include a proximal and a distal end.

The proximal end of each pump may be mechanically connected to a back pressure plate. More specifically, the back pressure plate may be pressure locked over the proximal end of each of the pumps. Additionally, the back pressure plate may include multiple orifices. In an example, the back pressure plate may include the same number of orifices as there are pumps in the spray head. Each pump may be slidably inserted through an orifice within the back pressure plate. In some embodiments, the back pressure plate may be triangular in shape although other shapes are within the scope of the disclosure.

One or more connectors may be disposed around each orifice within the back pressure plate. Each connector may be configured to reversibly connect the back pressure plate to a proximal end of one of the pumps. In an example, the connectors may be clips. As will be described below, when any one of the nozzles is in the "on" position, the adjacent pump and the back pressure plate move toward the front plate. There is little or no pressure on these connectors and, consequently, they do not disengage the proximal end of the pump from the back pressure plate. Conversely, when the nozzle is in an "off" position, the flow-through pressure through the pump is blocked. The piston within the adjacent pump is unable to move and the pump remains stationary. The back pressure plate moves toward the front plate and negative pressure is applied to the connectors. The connectors release the proximal end of the stationary pump from the back pressure plate. Each of the pumps is inserted through an orifice in the back pressure plate. The back pressure plate slides along the length of the stationary pump as the back pressure plate moves toward the front plate.

The spray head may include a single trigger which may actuate one or more of the pumps when the pump is in fluid connection with a nozzle that is in the "on" position. The trigger may be in connection with the back pressure plate through a trigger pump rod.

The spray head may include a plurality of hoses. Each hose may be in fluid communication with one of the pumps and with one of the nozzles. Each hose may extend downward into one of the containers. The hoses may be connected to the pumps with tube fittings as is known in the art. The spray head may include a pump housing which encloses the pumps, front plate, back pressure plate, connectors, and part of each of the hoses.

In another embodiment of the spray head, the spray head housing may include a laterally moveable selector switch indicator. This part may be moved laterally to allow the user to indicate which container he or she wishes to dispense fluid from. In some embodiments, the selector switch indicator may be disposed on the top side of the spray head.

In some embodiments, the spray head housing may include a plurality of selector switch positions into which the selector switch indicator may rest or be inserted. These selector switch positions may hold the selector switch indicator in the desired position until the user desires to change it.

A selector switch arm may be mechanically connected to the selector switch indicator. In some embodiments, selector switch indicator may be positioned on a top side of the spray head and the selector switch arm may extend downward along a rear side of the spray head. In some embodiments, the selector switch arm may be positioned at approximately a 45 degree angle relative to the selector switch indicator. The selector switch arm may include a first and a second end and connect to the selector switch indicator at the first end. The selector switch arm may include a pivot point at its second end where the selector switch arm pivots around a selector switch pivot point when a user moves the selector switch indicator between selector switch positions.

In this embodiment, the spray head may include a rotatable pump carriage which, in some embodiments, may include an arc-shaped housing. The rotatable pump carriage may be connected to a pump carriage pivot axle which may be in mechanical connection with a connector. The connector may include or consist of a rod which extends from the second end of the selector switch arm at one end of the rod and to the pump carriage pivot axle at the opposite end of the rod. In some embodiments, the connector extends from the second end of the selector switch arm at approximately a 45 degree angle (perpendicular) relative to the selector switch arm.

A plurality of pumps may be enclosed within the rotatable pump carriage. The pumps may be of any type described elsewhere herein. The plurality of pumps may be moved as the rotatable pump carriage rotates. In some embodiments, the pump which is disposed in a central position and in alignment with a fluid dispenser will be the pump which is actuated according to the mechanism described below.

The spray pump head may further include a plurality of tubes. Each tube may extend from one of the plurality of pumps on a proximal end of the tube and include a nozzle end on a distal end of the tube. The spray pump head may include a fluid dispenser which may include a plurality of orifices. Each nozzle end may be in fluid communication with an orifice in the fluid dispenser and fluid may pass through the orifice when its associated pump is actuated. In some embodiments, the fluid dispenser may be located on a front side of the spray pump head.

Similar to the previously described embodiment, each pump may be in fluid communication with a single hose. Each hose may extend from one of the plurality of pumps into one of the plurality of containers. Consequently, when an individual pump is actuated, its associated hose draws fluid from the container into which the hose extends.

Similar to the previous embodiment, this embodiment of the spray head may include a single trigger which may be in reversible mechanical connection with one of the plurality of pumps at any one time. A trigger pump actuator arm may include two ends and be mechanically connected to the trigger at one end and to one of the plurality of pumps at the other end. Consequently, when a user squeezes the trigger, the trigger pump actuator arm applies pressure to one of the pumps and actuates that pump. In some embodiments, the trigger and trigger pump actuator arm are mechanically connected to the pump that is in a central position relative to the remainder of the plurality of pumps and to the fluid dispenser.

In some embodiments, the pluralities of parts of the spray head referenced herein include two, three, four, or five of these parts. In some embodiments, the pluralities of parts of the spray head referenced herein include three of each part. For example, the spray head may have three pumps, three hoses, three tubes, three nozzle ends, and three orifices. In this example, the spray head may be connected to three reversibly connectable containers.

In any embodiment of the spray head, a spray handle may be disposed between the spray head and a container release housing. The spray handle may be shaped such that a user may comfortably wrap his or her fingers around the spray handle during use. The spray handle may include an upper end and a lower end. The upper end of the spray handle may be connected to the spray head and the lower end of the spray handle may be connected to the container release mechanism.

The container release mechanism may include a container release housing which may be reversibly connected to the top rim of each of the multiple containers. The top rim may define an opening on each of the containers. The container release housing may include a plurality of orifices which are at least partially defined by a plurality of walls. A lower edge of each wall may include a lip which may partially define one of a plurality of orifices. A container may be pushed upward into each orifice and snap into place as the top rim of the container moves over the lip. The container release mechanism may also include a plurality of release clips each of which may also partially define one of the orifices. Each release clip may similarly snap over the top rim of one of the containers.

The container release mechanism may include a plurality of push buttons each of which causes the release of one the plurality of containers when actuated. In an example, each push button may be in mechanical connection with a release bar which includes a first end and a second end. When a user squeezes the push button inward, the push button may apply inward pressure to the first end of the release bar. The second end of the release bar may apply pressure to a release clip within the container release housing which may partially define an orifice through which a container is inserted. The pressure may push the release clip outward which increases the size of the orifice allowing the container to slide out of the orifice. A spring which extends over each hose may decompress providing additional pressure to push the container out of the orifice.

Figure 2:
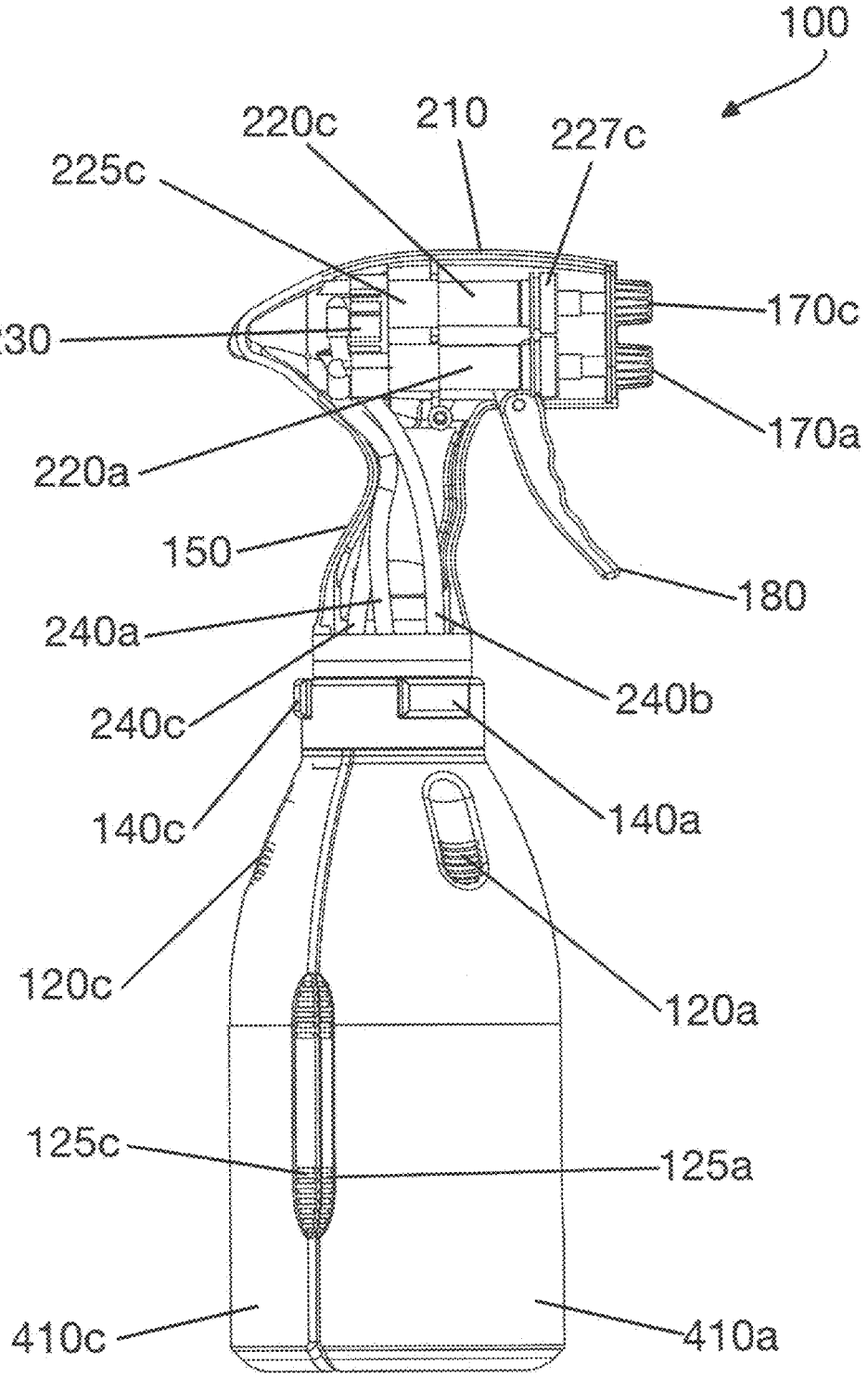
FIG. 2 is a perspective view of the multi-nozzle spray bottle of FIG. 1 with a cross-sectional view of the spray handle and pump housing.
Figure 5:
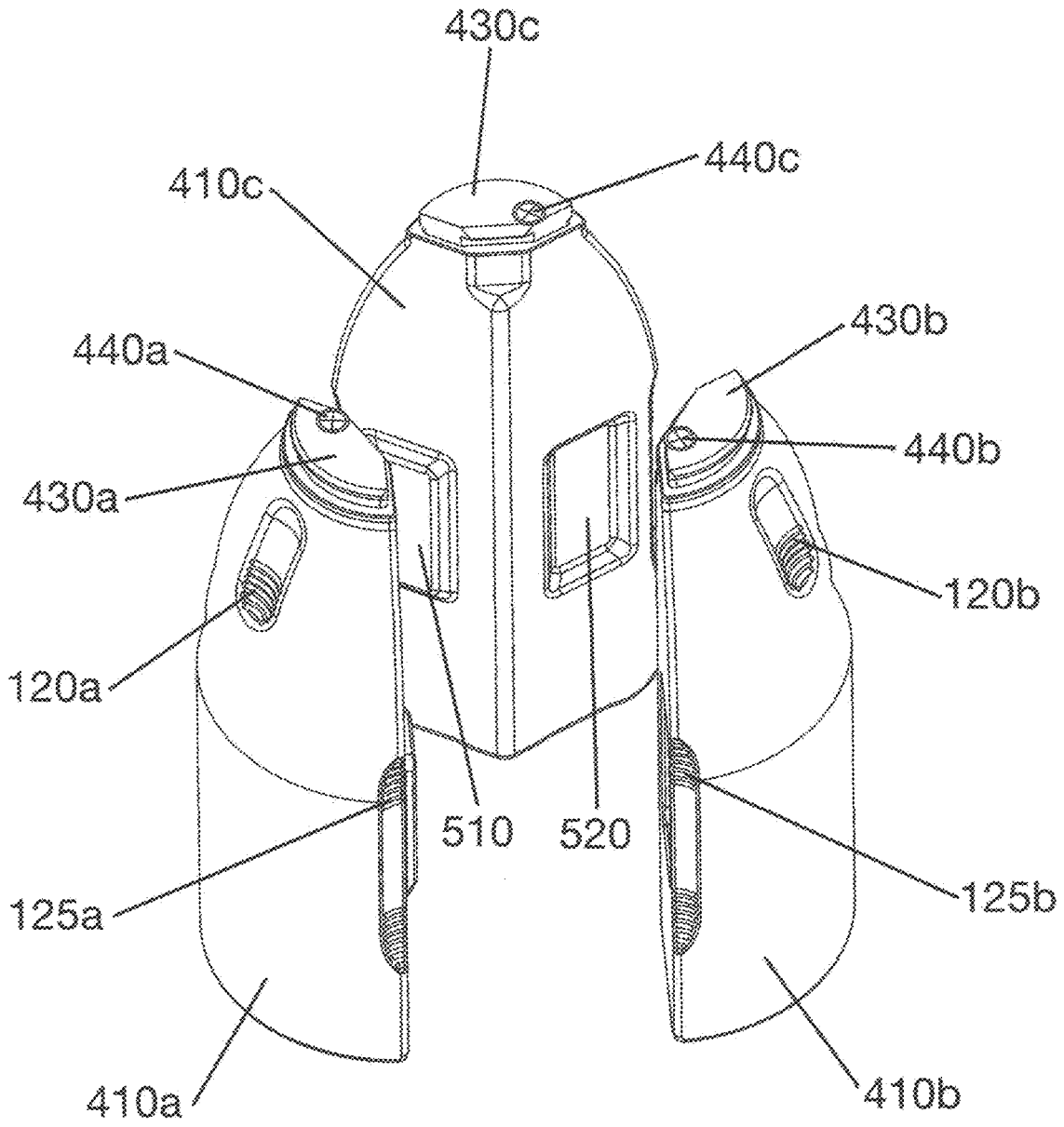
FIG. 5 is an exploded view of a triple-container bottle according to an embodiment of the disclosure.

Referring now to the drawings, FIG. 1 illustrates bottle 100 which is an embodiment of the disclosure. Bottle 100 is a triple-nozzle spray bottle and includes three containers, containers 110*a*, 110*b*, and 110*c*. Bottle 100 further includes finger indentations 125*a*, 125*b*, and 125*c* to which a user may apply his or her fingers during use of bottle 100 and thumb indention 120*a* to which a user may apply his or her thumb during use of bottle 100. Other finger indentations are present in this embodiment but not visible in this view. Thumb indentions 120*b* and 120*c* are present in this embodiment. and not visible in this view. Thumb indentations 120*b* and 120*c* are shown in FIGS. 2 and 5. In this embodiment, finger indentations 125*a*, 125*b*, and 125*c* and thumb indention 120*a* include ridges which may aid in gripping and workflow during use of bottle 100. Container release housing 130 is in connection with the tops of containers 110*a*, 110*b*, and 110*c* and includes push buttons 140*a* and 140*b*, shown in FIGS. 1 and 140*c* which is hidden in this view but visible in FIG. 2. When a user pushes any of push buttons 140*a*, 140*b*, or 140*c*, a spring-loaded mechanism ejects the adjacent container (one of containers 110*a*, 110*b*, and 110*c*). The user may refill or replace the ejected container with another container. Thus, it will be appreciated that container 140*a*, 140*b*, and 140*c* are interchangeable and easily replaced or refilled.

Spray handle 150 extends upward from container release housing 130 and connects the container release housing 130 to spray head housing 210. A user may wrap his or her fingers around spray handle 150 during use of bottle 100. Spray head housing 210 includes nozzles 170*a*, 170*b*, and 170*c* which dispense the fluids which may be housed in containers 110*a*, 110*b*, and 110*c* respectively. As discussed elsewhere herein, each of nozzles 170*a*, 170*b*, and 170*c* may be actuated or blocked at any given time to dispense any combination of fluids in containers 110*a*, 110*b*, and 110*c*. A user may dispense fluids from bottle 100 by squeezing trigger 180 which extends below spray head housing 210.

FIG. 2 illustrates bottle 100 of FIG. 1 and further illustrates a cross-sectional view of the spray handle and spray head. The spray head includes a pump mechanism which is within spray head housing 210. Each of containers 110*a*, 110*b*, and 110*c* is in fluid communication with a pump. In this embodiment, there are three pumps, pumps 220*a*, 220*b*, and 220*c*. Pump 210*c* is not visible in this view but first presented in FIG. 3A. It will be appreciated that a multi-nozzle spray bottle according to the disclosure may have a different number of containers and, accordingly, the same number of pumps. Pumps 220*a*, 220*b*, and 220*c* each include a proximal end and a distal end. Proximal end 225*c* and distal end 227*c* of pump 220*c* are shown. Proximal and distal ends of pump 220*a* are not labeled for purposes of clarity.

Figure 7:
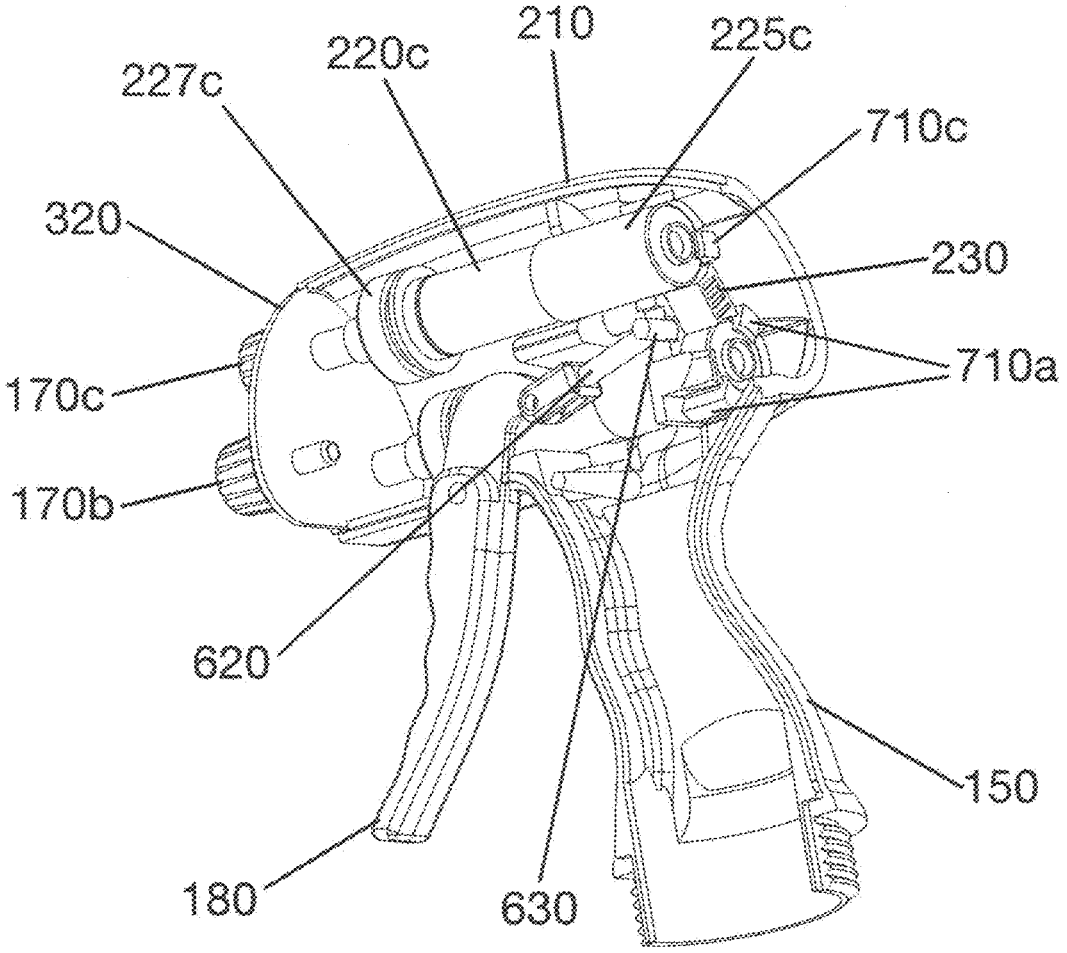
FIG. 7 shows a perspective view of a trigger pump mechanism within a spray head according to an embodiment of the disclosure.

Proximal end 225*c* of pump 220*c*, as well as the proximal ends of the other pumps, are in mechanical connection with back pressure plate 230 and may be reversible attached through connectors. In some embodiments, the connectors may be clips as illustrated in FIG. 7. In this embodiment, back pressure plate 230 is triangular-shaped although one of skill in the art will appreciate that other shapes are within the scope of the disclosure. Back pressure plate 230 may pressure lock over the proximal end of each of each of pumps 220*a*, 220*b*, and 220*c*. In this position, all three of pumps 220*a*, 220*b*, and 220*c* may actuate when trigger 180 is actuated, thus causing fluid from all three of containers 110*a*, 110*b*, and 110*c* to move through the pump mechanism and out one of nozzles 170*a*, 170*b*, or 170*c*. Hoses 240*a*, 240*b*, and 240*c* extend from the proximal end of each of pumps 220*a*, 220*b*, and 220*c* respectively into one of containers 110*a*, 110*b*, and 110*c*. When one or more of pumps 220*a*, 220*b*, and 220*c* is actuated, fluid is drawn from the corresponding container and into the corresponding pump. Fluid drawn from one or more of containers 110*a*, 110*b*, and 110*c* is then dispensed out through one or more of nozzles 170*a*, 170*b*, or 170*c* respectively. Each of nozzles 170*a*, 170*b*, and 170*c* may include one or more of a plain-orifice nozzle, a shaped-orifice nozzle, a surface-impingement single-fluid nozzle, a spiral spray nozzle, a pressure-swirl single-fluid spray nozzle, a spillback nozzle, a solid-cone single-fluid nozzle, or any other single-fluid nozzle known in the art.

Figure 3A:
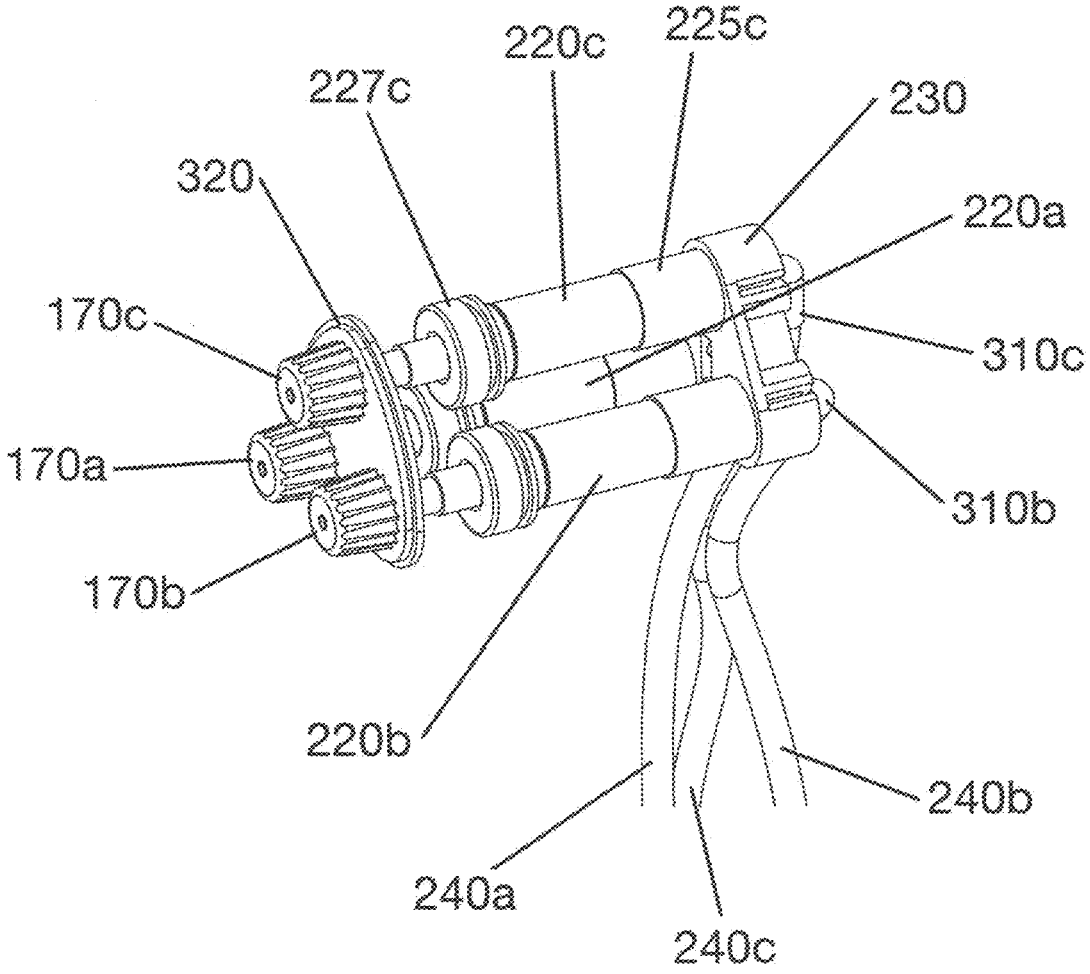
FIG. 3A is a perspective view of a pump mechanism which may be included in an embodiment of the disclosed spray bottle.
Figure 3B:
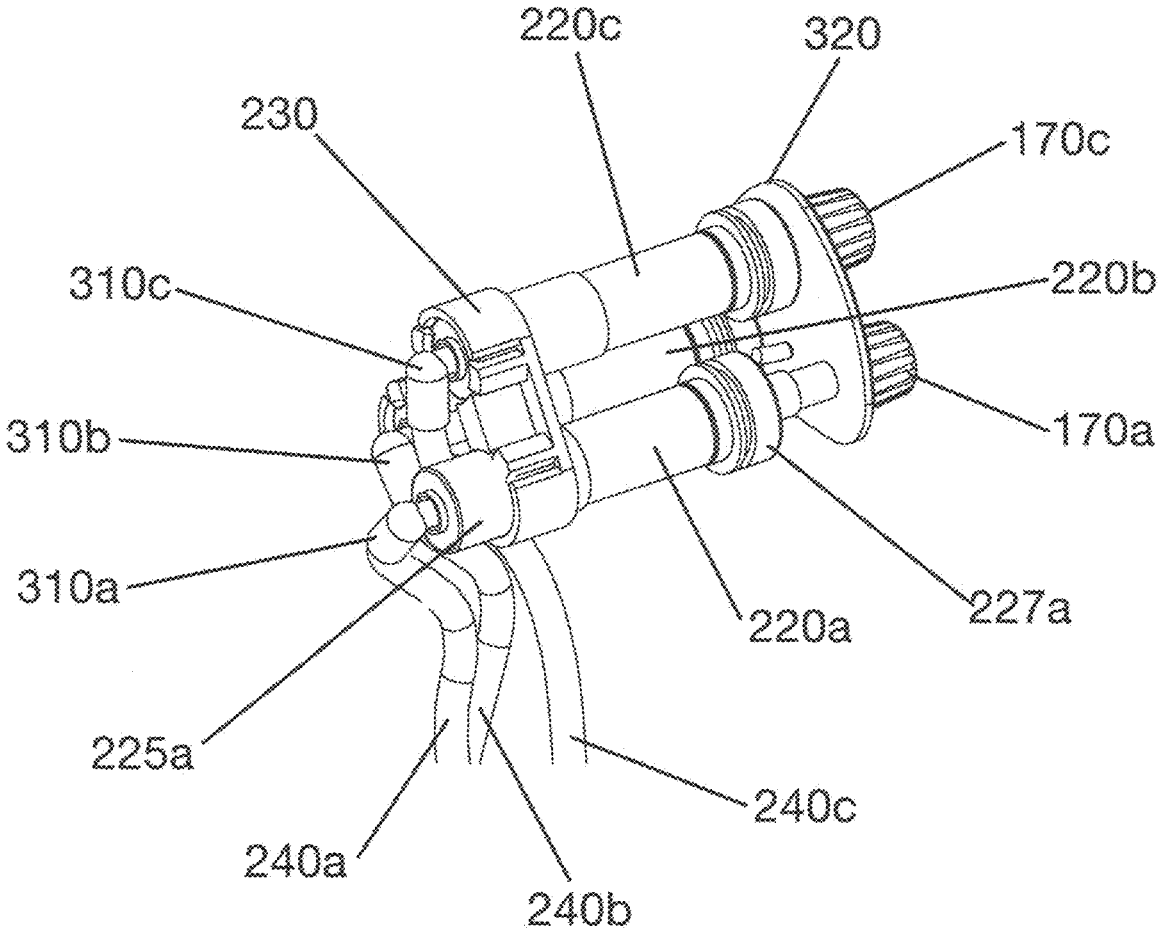
FIG. 3B is a perspective view of the pump mechanism of FIG. 3A illustrating two of the three pumps actuated.

FIGS. 3A and 3B illustrate a close-up view of an embodiment of the pump mechanism. In FIG. 3A, all three of pumps 220*a*, 220*b*, and 220*c* are in an "on" position in which all three of nozzles 170*a*, 170*b*, and 170*c* are open and ready to dispense fluid. Nozzles 170*a*, 170*b*, and 170*c* are in mechanical connection with a first side of front plate 320. Additionally, distal end 227*c* of pump 220*c*, as well as the distal ends of pumps 220*a* and 220*b*, are in mechanical connection with a second side of front plate 320 which is opposite the side in mechanical connection with nozzles 170*a*, 170*b*, and 170*c*.

Back pressure plate 230 includes a plurality of orifices. The proximal end of each of pumps 220*a*, 220*b*, and 220*c* is inserted into one of the plurality of orifices and, when the connectors are engaged, the piston pumps move toward front plate 320 in response to pressure from back pressure plate 230. Tube fitting 310*c* (not visible in this view)

connects the proximal end 227*c* of pump 220*c* to hose 240*c*. Likewise, tube fittings 310*a*, and 310*b* connect the proximal ends of pumps 220*a* and 220*b* respectively to hoses 240*a* and 240*b* respectively. In response to the flow-through pressure created by actuating all three pumps, fluid may be drawn through hoses 240*a*, 240*b*, and 240*c*, through the pump mechanism and out through nozzles 170*a*, 170*b*, and 170*c*.

In FIG. 3B, nozzle 170*a* has been turned to an "off" position which blocks the flow-through pressure and thereby blocks the flow of fluid through the sections of the pump mechanism which are in fluid communication with nozzle 170*a*. The connectors which reversibly connect back pressure plate 230 to proximal end 225*a* of pump 220*a* have been disengaged. Consequently, when trigger 180 is actuated and back pressure plate 230, moves toward front plate 320, pump 220*a* does not move toward front plate 320 along with pumps 220*b* and 220*c*. Rather, back pressure plate 230 moves lengthwise along pump 220*a* toward its distal end 227*a* as pump 220*a* passes through an orifice in back pressure plate 230. While pumps 220*b* and 220*c* move toward front plate 320 drawing fluid through hoses 240*b* and 240*c*, pump 220*a* remains relatively motionless and no fluid moves through hose 240*a*.

Figure 4:
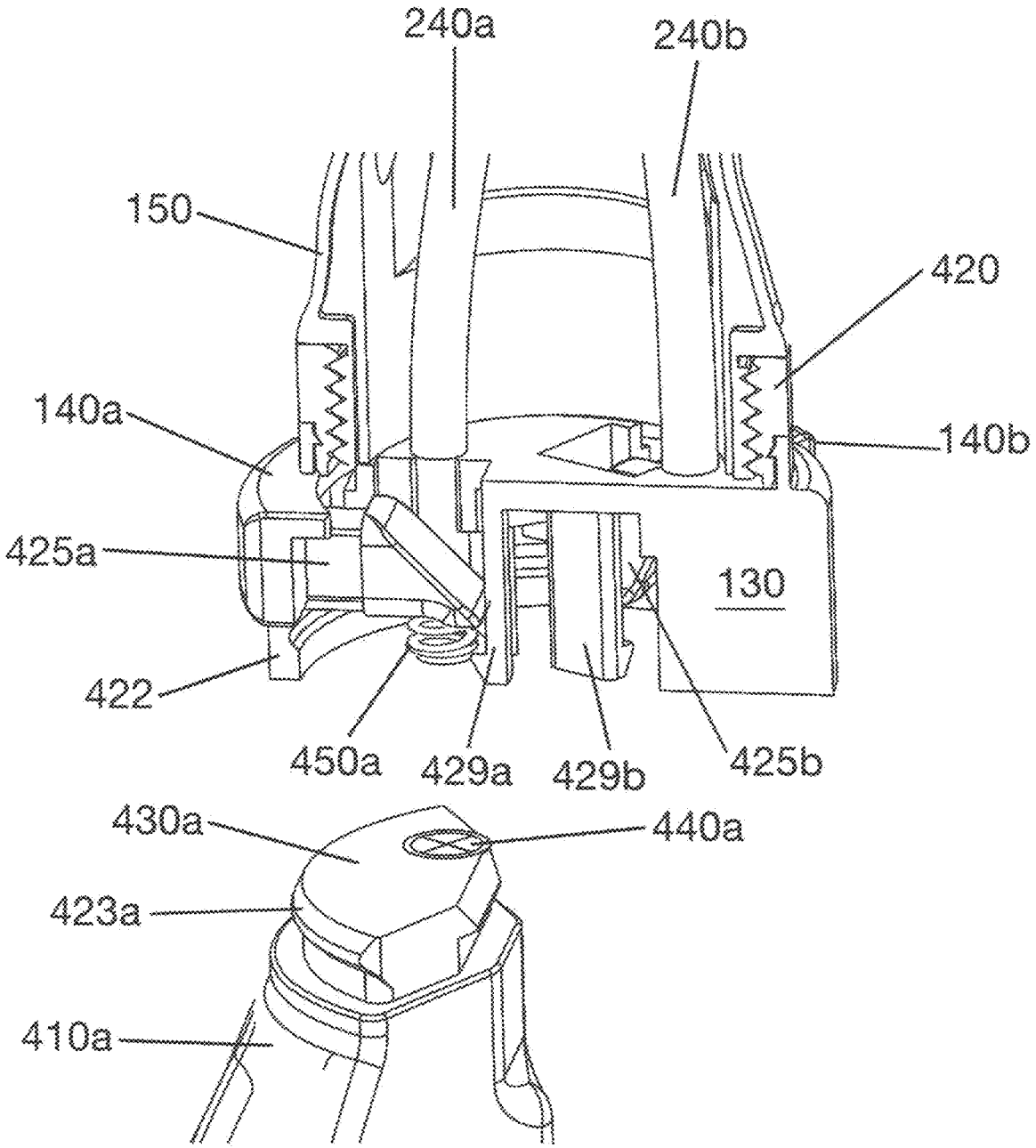
FIG. 4 includes a cross-sectional view of a container release mechanism and a perspective view of a container of a triple-container bottle according to an embodiment of the disclosure.

FIG. 4 illustrates a close up view of a container release mechanism which may be included in an embodiment of the disclosed multi-nozzle multi-container fluid spray device. Container 410*a* is also shown which is an embodiment of one of a plurality of disposable and/or replaceable containers which may be included in an embodiment of the disclosed multi-nozzle multi-container fluid spray device.

Container release housing 130 houses parts which function to reversibly connect a spray handle (in this embodiment, spray handle 150 originally presented in FIG. 1) to the plurality of containers which includes container 410*a*. Container release housing 130 includes threaded locking ring 420 which connects container release housing 130 to spray handle 150. Lip 422*a* and container clip 429*a* at least partially define one of a plurality of orifices. Top rim 423*a* of container 410*a* may be pushed through the orifice and beyond lip 422*a* and container clip 429*a*. Lip 422*a* and container clip 429*a* may then snap back in place securing the top rim 423*a* above lip 422*a* and container clip 429*a*.

Container release housing 130 also includes push button 140*a* which is in mechanical connection with release bar 425*a*. Likewise, push button 140*b* is in mechanical connection with release bar 425*b* which, in turn, is in mechanical connection with container clip 429*b*. In summary, each push button on the disclosed device may be in mechanical connection with a release bar and a container may be secured by sliding a top rim of a container over an associated lip and container clip. An example of a mechanism through which container 410*a* may be inserted and released is described below. A container may be released by actuating push button 140*b* when corresponding parts participate in the same mechanism.

A container clip holds each container in place by clipping under the top rim of each container. FIG. 4 shows container clip 429*a* which may help to secure container 410*a* when container 410*a* is inserted into the container release mechanism. As shown, container clip 429*a* compresses container ejector spring 450*a*. When container 410*a* is inserted into the container release mechanism, container clip 429*a* may slip under top rim 423*a* of container 410*a* at the inner most section of top rim 423*a*. The opposite side of top rim 423*a* may also slip under lip 422*a*. Container ejector spring 450 continues to be compressed and applies pressure to seal 430*a* which helps to secure seal 430*a* to container 410*a*.

When a user desires to release or replace container 410*a*, the user may squeeze push button 140*a* inward which applies inward pressure to a first end of release bar 425*a*. Push button 140*a* thereby moves from a first position to a second position (left to right as shown in FIG. 4) and causes release bar 425*a* to move from a first position to a second position (also left to right as shown in FIG. 4). The second end of release bar 425*a* applies lateral pressure to container clip 429*a*. Container clip 429*a* releases ejector spring 450*a* which extends downward pushing container 410*a* downward, thus ejecting container 410*a*.

Container 410*a* includes seal 430*a* over the opening of container 410*a*. Seal 430*a* includes hose receptacle 440*a*. When container 410*a* is snapped into container release housing 130 as described above, hose 240*a* may insert through hose receptacle 440*a* and thus descend into container 410*a*. Ejector spring 450*a* slides around tube 240*a*. When container 410*a* is inserted into the container release mechanism, ejector spring 450*a* is compressed and aids in securing top rim 423*a* of container 410*a* tightly against seal 430*a*.

FIG. 5 illustrates an exploded view of three containers, containers 410*a*, 410*b*, and 410*c*, which may be included in an embodiment of the disclosed device. FIG. 5 includes container 410*a*, part of which was originally presented in FIG. 4. Containers 410*b* and 410*c* are similar or identical to container 410*a*.

As shown in FIG. 5, containers 410*a*, 410*b*, and 410*c* may be separated from each other. Container 410*a* includes seal 430*a* and hose receptacle 440*a*, container 410*b* include seal 430*b* and hose receptacle 440*b*, and container 410*c* includes seal 430*c* and hose receptacle 440*c*. Thumb indentations 120*a* and 120*b* as well as finger indentations 125*a* and 125*b* are visible in this view. Male notch 510 and female notch 520 are shown on container 410*c*. While not visible, containers 410*a* and 410*b* also include a male notch and a female notch. Male notch 510 on container 410*a* may insert into a female notch on containers 410*b* and 410*c*. Likewise, the male notches on containers 410*b* and 410*c* may insert into female notch 520 on container 410*a*.

Figure 6A:
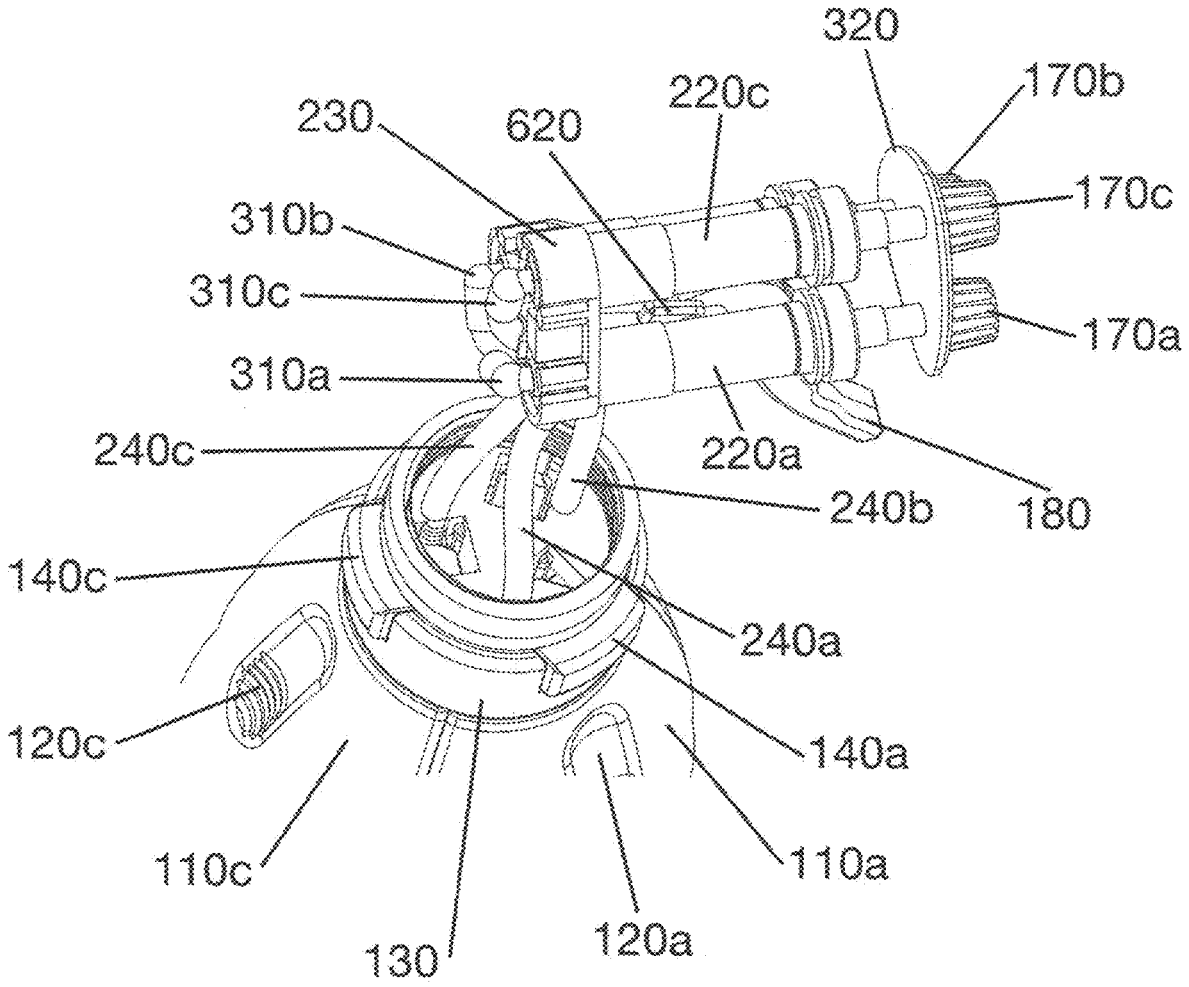
FIG. 6A is an elevated perspective view of a pump mechanism, hoses, and three combined containers according to an embodiment of the disclosure.

FIG. 6A illustrates a pump mechanism being inserted into three containers which have been connected to each other. The pump housing and container release housing are not shown so that the viewer may visualize the parts of the pump mechanism. The pump mechanism of FIG. 6A is as shown in FIGS. 3A and 3B. Trigger 180 is in mechanical connection with trigger pump rod 620 which, in turn is in mechanical communication with back pressure plate 230. Trigger pump rod 620 pulls back pressure plate 230 forward toward front plate 320 when trigger 180 is engaged. Hoses 240*a*, 240*b*, and 240*c* extend into containers 410*a*, 410*b*, and 410*c* respectively. Each of hoses 240*a*, 240*b*, and 240*c* insert into hose receptacles 440*a*, 440*b*, and 440*c* respectively as originally presented in FIG. 4.

Figure 6B:
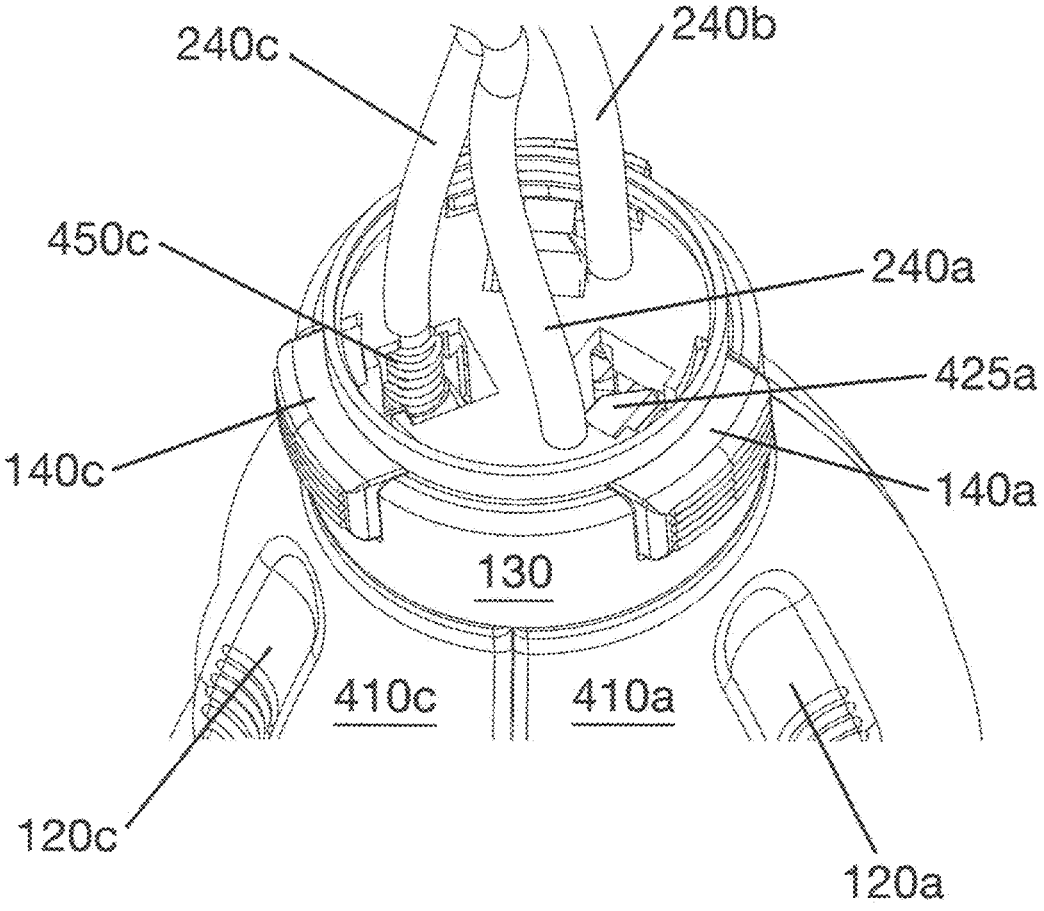
FIG. 6B is a close-up view of the hoses in FIG. 6A entering the three combined containers.

FIG. 6B is a close-up view of hoses 240*a*, 240*b*, and 240*c* entering three combined containers through hose receptacles 440*a*, 440*b*, and 440*c* respectively as illustrated in FIG. 5. Ejector spring 450*c* is shown extending over hose 240*c*.

FIG. 7 shows the trigger pump mechanism within a spray head according to an embodiment of the disclosure. Trigger 180 is in mechanical connection with trigger pump rod 620 which, in turn, is connected to connecting pivot 630. Connecting pivot 630 inserts into a slot on back pressure plate 230 and may pivot within its slot to allow for movement but still maintain a constant connection with back pressure plate 230. This mechanism may prevent slippage and possible catching or other types of malfunction when trigger 180 is actuated and pump rod 620 applies pressure to back pressure plate 230.

Pump clips secure each of pumps 220*a*, 220*b*, and 220*c* to back pressure plate 230. FIG. 7 shows pump clip 710*c* in connection with proximal end 225*c* of pump 220*c*. Similarly, pump clip 710*a* is in connection with pump 220*a*. Each pump clip holds its corresponding pump in an engaged position when the pump is being activated. When one or more of nozzles 170*a*, 170*b*, or 170*c* is turned to the "off" position, the flow-through pressure to the corresponding pump is blocked. The pump clips in connection with the corresponding pump are released when trigger 180 is actuated and the pump clips are allowed to disengage from the corresponding pump. Back pressure plate 230 is free to move over the corresponding pump which remains stationary. This mechanism provides full flexibility and customization of the nozzle spray settings.

Figure 8:
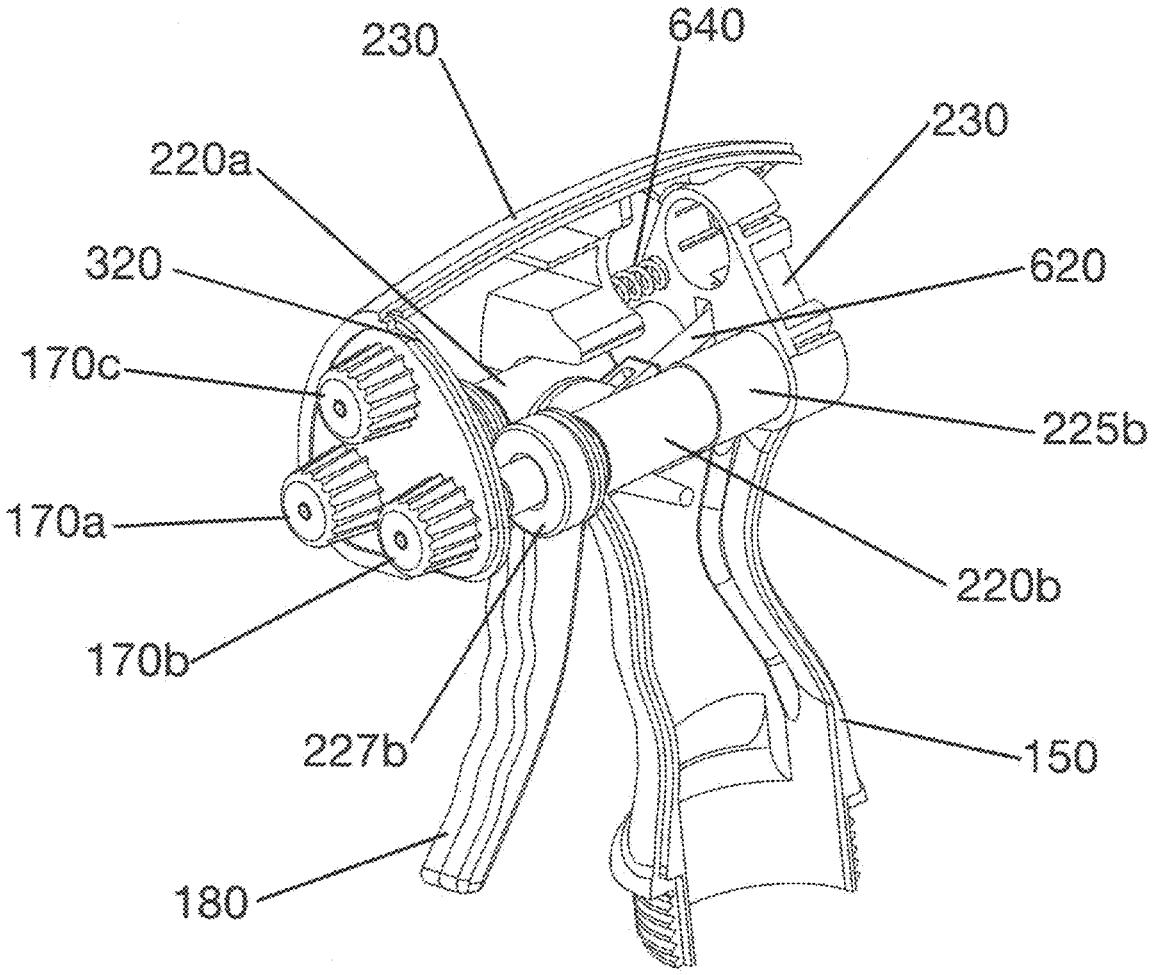
FIG. 8 shows a perspective view of a trigger pump mechanism within a spray head in which the back pressure plate may return to its starting position after the trigger has been actuated according to an embodiment of the disclosure.

FIG. 8 illustrates the mechanism through which back pressure plate 230 returns to its starting position after trigger 180 has been actuated in a situation in which all three of nozzles 170*a*, 170*b*, and 170*c* are turned to the "off" position. Pump 220*b* with its proximal end 225*b* and distal end 227*b* are shown. Pump 220*c* is omitted for purposes of clarity. When all three of nozzles 170*a*, 170*b*, and 170*c* are turned to the "off" position, the flow-through pressure through pumps 210*a*, 210*b*, and 210*c* is blocked. When trigger 180 is actuated, the trigger pump mechanism described above and illustrated in FIG. 7 moves back pressure plate 230 forward toward front plate 320. As it moves, back pressure plate 230 compresses return spring 640 creating tension. When trigger 180 is disengaged, return spring 640 releases the tension and decompresses, thus returning back pressure plate 230 to its starting position.

Figure 9:
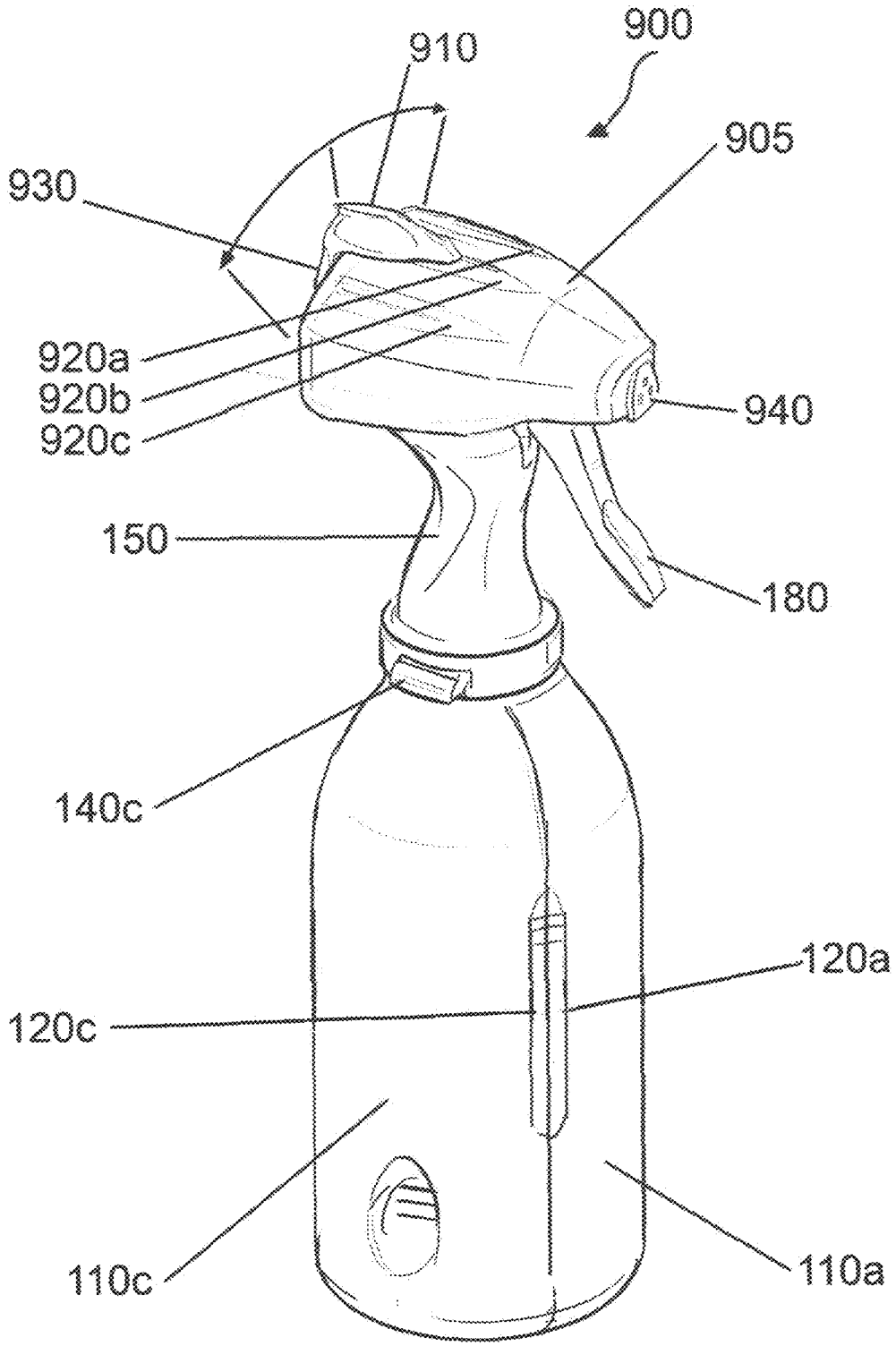
FIG. 9 is a perspective view of a triple container bottle according to an embodiment of the disclosure as shown from a side.

FIG. 9 illustrates bottle 900 which is a second embodiment of the disclosed spray bottle. The differences between bottle 900 and bottle 100 are mainly found in and within spray head housing 905 and spray head housing 210 respectively. Bottle 900 includes selector switch indicator 910 on the top of spray head housing 905. Selector switch indicator 910 may be moved laterally between three selector switch positions (920*a*, 920*b*, and 920*c*) along the curved axis shown by the double-headed arrow. In this embodiment, selector switch positions 920*a-c* include slits into which selector switch indicator 910 may insert into. Each of selector switch positions 920*a-c* connects a different container to its respective pump so that the contents of that container may be delivered through fluid dispenser 940.

Figure 10:
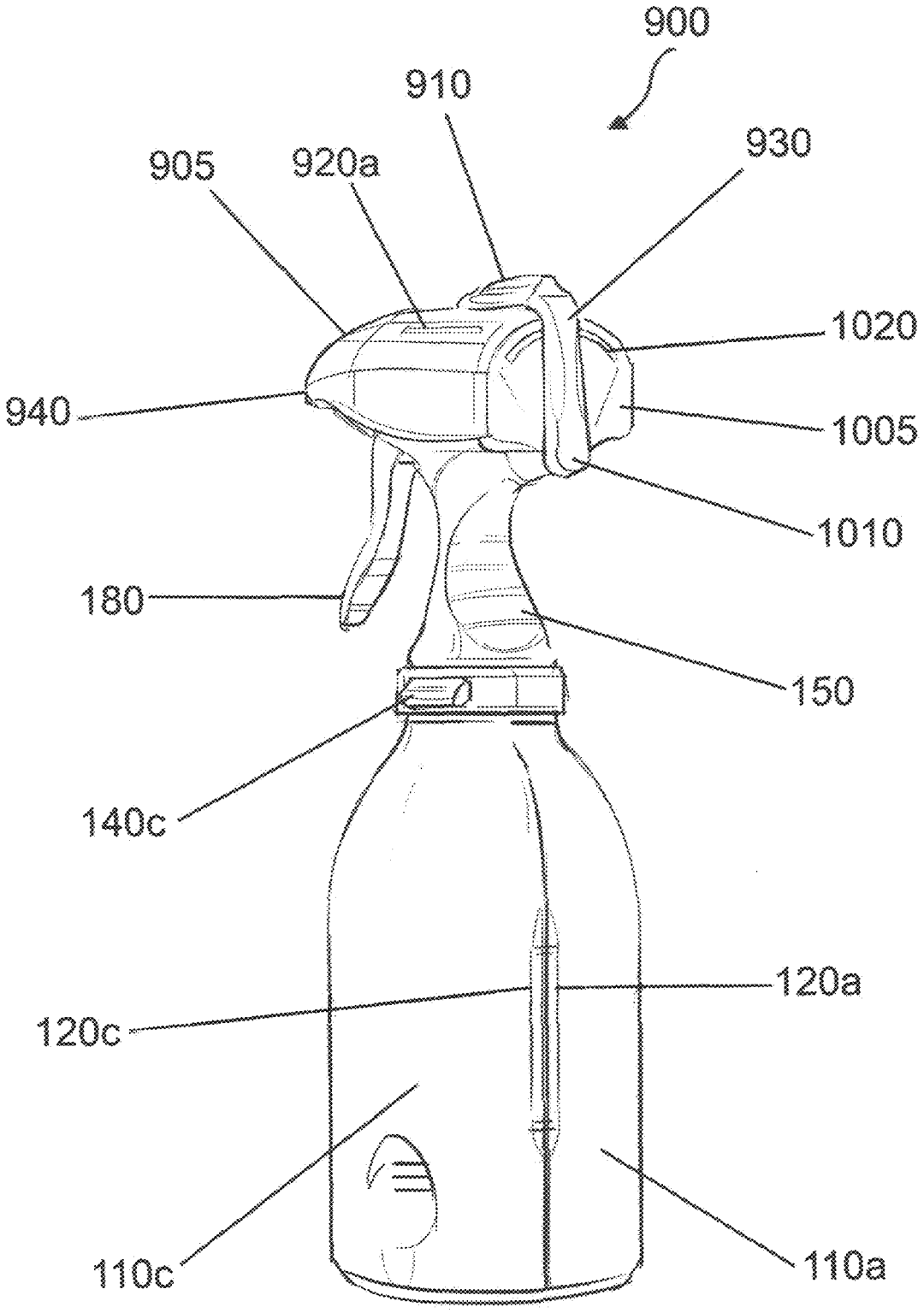
FIG. 10 is a perspective view of the embodiment of FIG. 9 shown from the rear side of the bottle.

FIG. 10 illustrates a rear view of bottle 900. Selector switch indicator 910 is in mechanical connection with selector switch arm 930 (partially visible in FIG. 9) which extends downward along the rear side 1005 of spray head housing 905. Selector switch indicator 910 and selector switch arm 930 are positioned at approximately a 45 degree angle relative to each other. Selector switch arm 930 includes selector switch pivot point 1010. When a user moves selector switch indicator 910 laterally between selector switch positions 920*a-c* (shown in FIG. 9), selector switch arm 930 pivots at selector switch pivot point 1010, thus moving along an arc defined by selector switch arm slot 1020.

Figure 11:
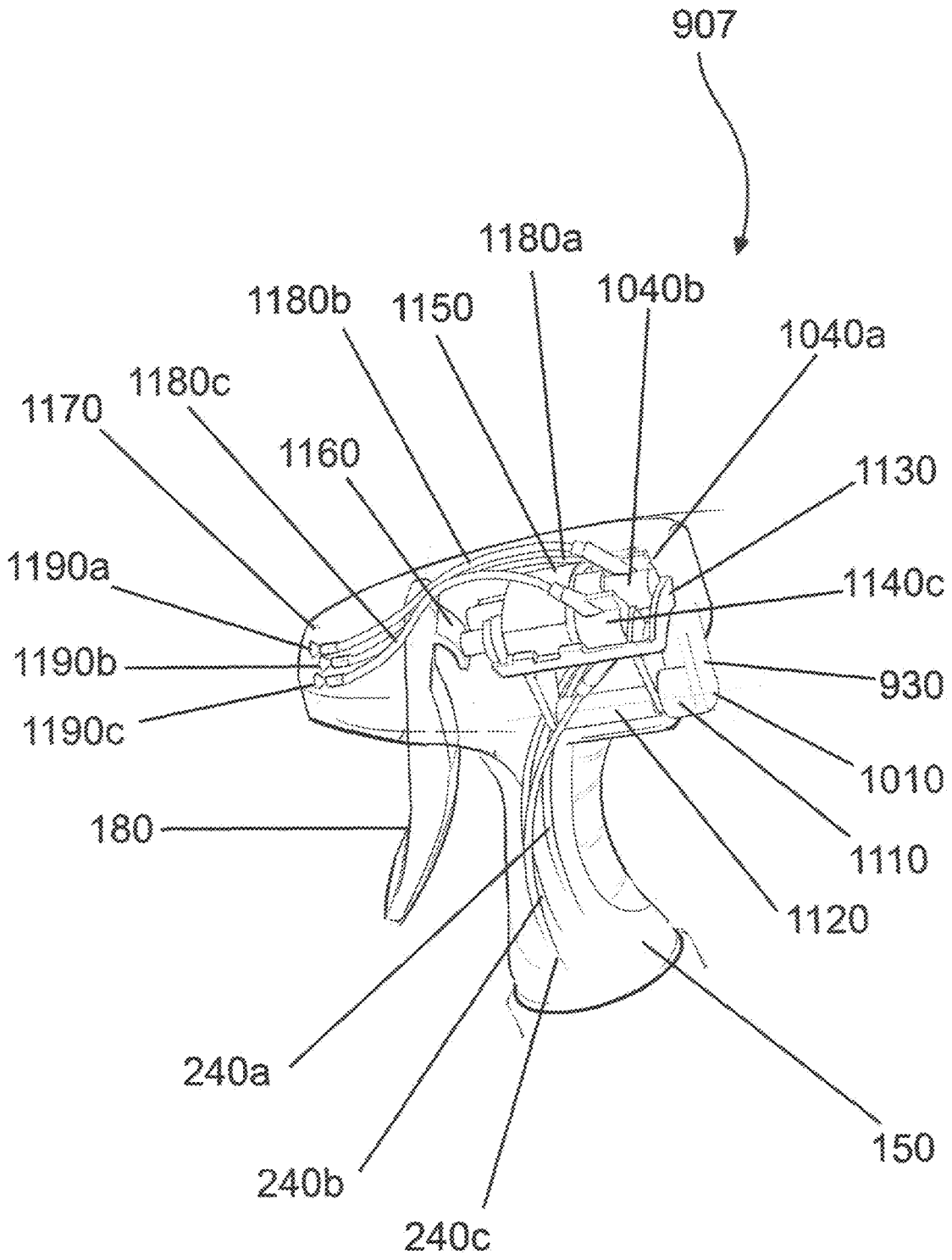
FIG. 11 is a close-up view of the spray head housing shown in the embodiment of FIG. 9 with a transparent spray head housing.

FIG. 11 shows an up close view of the parts within spray head housing 905. As illustrated in FIG. 11, selector switch arm 930 is in connection with connector 1110. In this embodiment, connector 1110 is a bar extending from selector switch arm 930 at approximately a 45 degree angle, although other angles and connector designs known in the art are within the scope of this disclosure. Connector 1110 connects to selector switch arm 930 at the selector arm pivot point 1010 and is in mechanical communication with pump carriage pivot axle 1120. In this embodiment, pump carriage pivot axel 1120 extends downward from and is in mechanical connection with pump carriage 1130.

Pump carriage 1130 of bottle 900 is an arch-shaped housing that cradles pumps 1140*a*, 1140*b*, and 1140*c* and pivots the proper pump into the center position from a left or right side start point so that it can engage trigger 180 at its stationary position. In this embodiment, pump carriage 1130 is covered by pump carriage securing cover plate 1150.

More specifically, when the pump (selected from pumps 1140*a-c*) that is positioned within the left side of pump carriage 1130 is moved into the center position by moving selector switch indicator 910 to the right most selector switch position, then the left side pump comes into contact with the stationary centered trigger 180.

Conversely, when the pump that is positioned within the right side of pump carriage 1130 is moved into the center position by moving selector switch indicator 910 to the left most selector switch position, the right side pump comes into contact with the stationary centered trigger 180.

While bottle 900 includes three pumps, other embodiments may include two pumps, four pumps, or more than four pumps. In some embodiments, the pumps are standard spray trigger models, market accepted, one-way valve type, that use a reciprocal type leading to the fluid containers, and an expulsion tube leading to the nozzle end.

Each of pumps 1140*a-c* is potentially activated by a single trigger, trigger 180. Trigger pump actuator arm 1160 is in mechanical connection with trigger 180. When a user squeezes trigger 180, trigger pump actuator arm 1160 applies positive pressure on the pump which is in the centered position and which is in mechanical connection with trigger pump actuator arm 1160. The action that occurs when the user squeezes trigger 180 creates the pressure needed to actuate the center pump according to its function.

When the pump in the centered position relative to trigger pump actuator arm 1160 is actuated, fluid is drawn through one of hoses 240*a*, 240*b*, and 240*c*, whichever is in fluid communication with the pump in the centered position. As in bottle 100, hoses 240*a*, 240*b*, and 240*c* each extend into a separate one of containers 110*a*, 110*b*, or 110*c* (shown in other drawings). When the fluid reaches the pump in the centered position, it continues through one of tubes 1180*a*, 1180*b*. or 1180*c*, each of which is in fluid communication with one of pumps 1140*a-c* respectively. More specifically, if pump 1140*b* is in the centered position, fluid from container 110*b* is drawn through hose 240*b* into pump 1140*b* and into tube 1180*b*.

Tubes 1180*a-c* are in fluid communication with nozzle ends 1190*a-c* respectively which are positioned at spray head front 1170. Fluid is dispensed through the nozzle end which is in communication with the tube extending from the pump in the centered position. For example, if pump 1140*b* is in the centered position, fluid from container 110*b* will move through hose 240*b* into pump 1140*b*, leave pump 1140*b* through tube 1180*b*, and then enter nozzle end 1190*b*.

Each of the nozzle ends 1190*a-c* are in connection with three way fluid dispenser 940 (shown in FIG. 9) which includes three orifices, each in connection with one of nozzle ends 1190*a-c*, through which fluid passes. In this embodiment, the three orifices are in close proximity to each other. Consequently, it may appear to a user that there is only a single orifice through which each of the three fluids passes.

By delivering a mostly centered spray experience, the friendliness and familiarity of spray bottle known in the art with which the user may be familiar.

Figure 12:
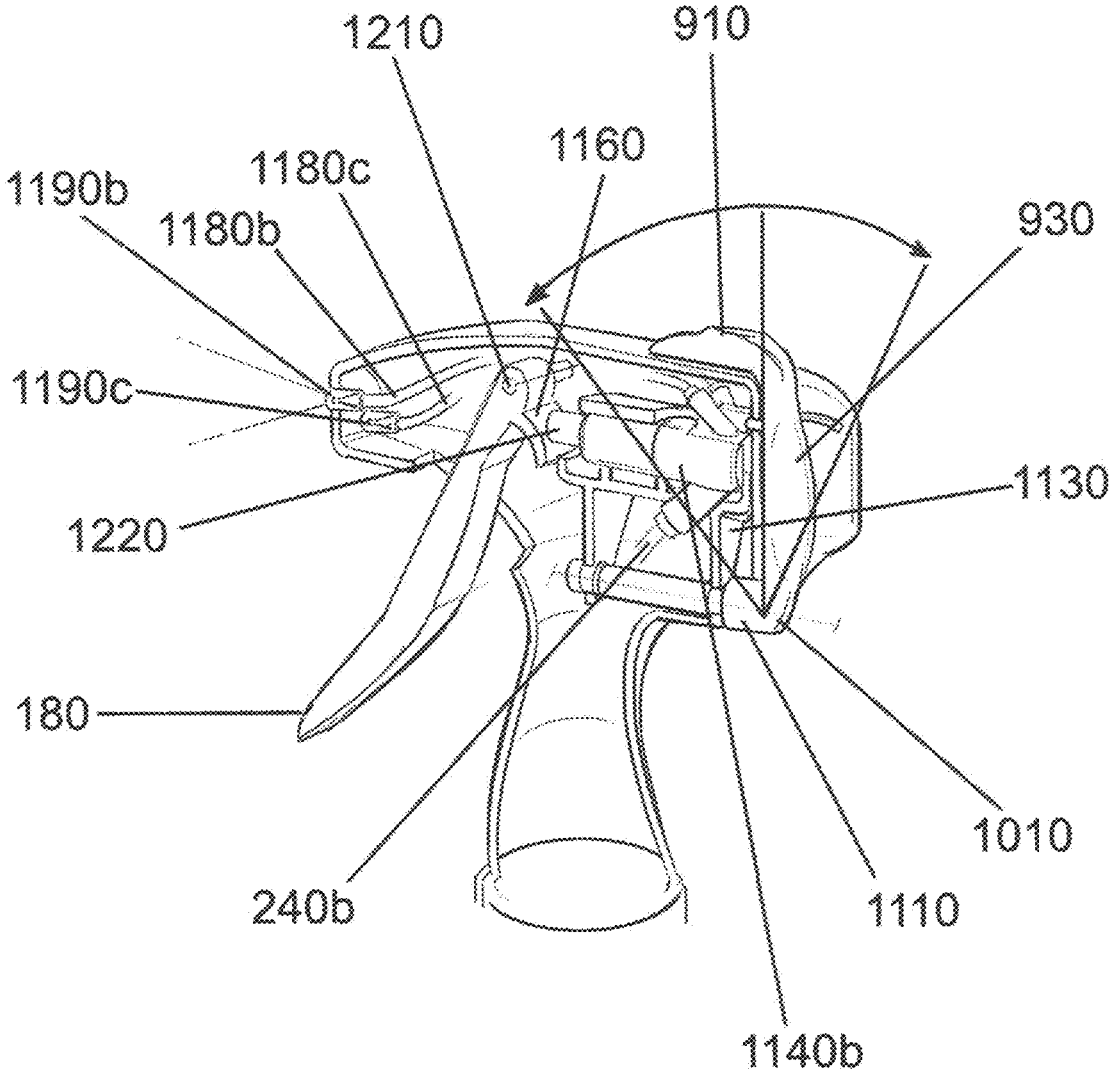
FIG. 12 shows the embodiment of FIG. 11 with a cutaway view of the spray head housing.

FIG. 12 shows a cross section of the spray head and further illustrates the mechanism through which bottle 900 may be used. In FIG. 12, pump 1140*b* is in the centered position and in mechanical connection with trigger pump actuator arm 1160. Pump 1140*b* was moved to the centered position when a user rotated selector switch indicator 910 to selector switch position 920*b*. Selector switch arm 930 was thus rotated at selector switch pivot point 1010 causing connector 1110 to rotate pump carriage 1130 until pump 1140*b* is in the centered position as described above.

When a user squeezes trigger 180, it rotates around trigger pivot point 1210 and causes trigger pump actuator arm 1160 to apply pressure to pump 1140*b* at center pump connecting point 1220. This pressure actuates pump 1140*b* (but not pumps 1140*a* or 1140*c*) which draws fluid through hose 240*b* (but not hoses 240*a* or 240*c*). As in the embodiment of bottle 100, hoses 240*a-c* only extend into their respective containers 110*a-c*. Consequently, there is no mixing of fluids when the user squeezes trigger 180. The fluid travels from hose 240*b* into pump 1140*b* then out of pump 1140*b* through tube 1180*b*. The fluid then moves into nozzle end 1190*b* which is within three way fluid dispenser 940 (shown in FIG. 9).

Figure 13:
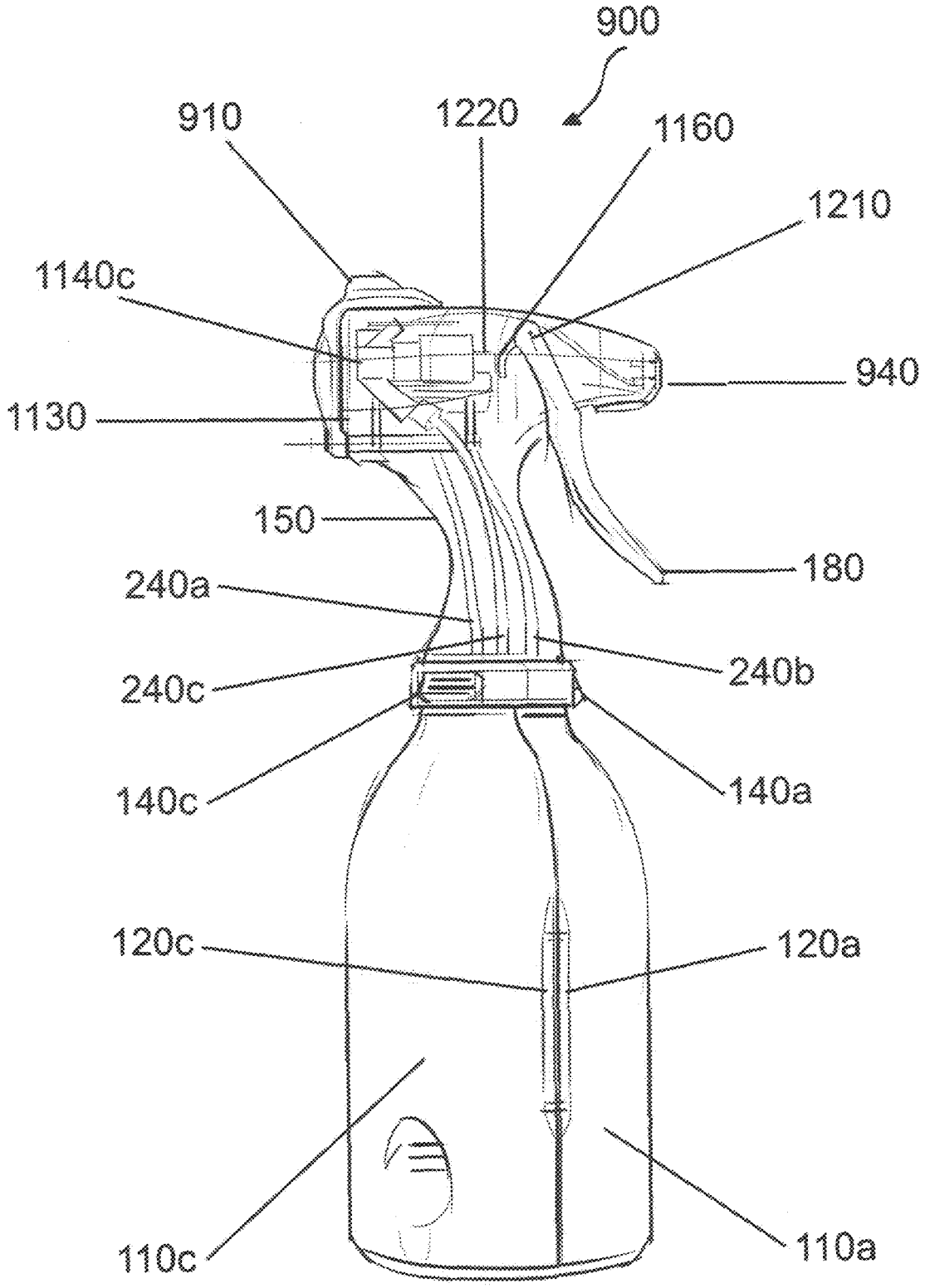
FIG. 13 is a perspective view of the embodiment of FIG. 9 with a transparent spray head housing.

FIG. 13 shows bottle 900 with a transparent spray head housing 905 making the parts within visible. FIG. 13 further illustrates the spray head as illustrated in FIG. 12 in connection with the three containers, 110*a-c*. The parts below spray handle 150 may be as described with regard to bottle 100. In FIG. 13, selector switch indicator 910 is rotated to selector switch position 920*c*. Pump carriage 1130 has been rotated counterclockwise (to the right) according to the mechanism described above to position pump 1140*c* in the centered position and in connection with trigger pump actuator arm 1160. When a user squeezes trigger 180, it rotates clockwise around trigger pivot point 1210, thus causing trigger pump actuator arm 1160 to apply positive pressure to pump 1140*c* at center pump connecting point 1220. This pressure actuates pump 1140*c* causing it to draw fluid from container 110*c* through hose 240*c* which extends into container 110*c*. The fluid passes into pump 1140*c* and exits through tube 1180*c* shown in FIG. 11. The fluid then passes through nozzle end 1190*c* which is in connection with tube 1180*c* and exits nozzle end 1190*c* through the orifice in three way fluid dispenser 940 which is in communication with nozzle end 1190*c*.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A multi-container fluid spray device comprising:

a. a plurality of reversibly connectable containers;

b. a spray head, wherein the spray head is in reversible mechanical connection with the plurality of reversibly connectable containers, and wherein the spray head comprises:

i. a plurality of nozzle ends;

ii. a rotatable pump carriage;

iii. a plurality of pumps, the plurality of pumps enclosed within the rotatable pump carriage;

iv. a laterally movable selector switch indicator;

v. a selector switch arm comprising a first end and a second end, wherein the first end is in mechanical connection with the laterally moveable selector switch indicator and the second end is in mechanical connection with the rotatable pump carriage;

vi. a plurality of tubes, each comprising a proximal end and a distal end, wherein the proximal end of each of the plurality of tubes is in mechanical connection with one of the plurality of pumps, and wherein the distal end of each of the plurality of tubes is in mechanical connection with one of the plurality of nozzle ends;

vii. a single trigger, wherein the single trigger is in reversible mechanical connection with one of the plurality of pumps; and c. a plurality of hoses, each in fluid communication with one of the plurality of pumps, and each extending into one of the plurality of reversibly connectable containers.

2. The multi-container fluid spray device of claim 1, wherein the plurality of reversibly connectable containers consists of three containers.

3. The multi-container fluid spray device of claim 2, wherein the plurality of pumps consists of three pumps.

4. The multi-container fluid spray device of claim 2, wherein the plurality of hoses, consists of three hoses.

5. The multi-container fluid spray device of claim 2, wherein the plurality of tubes, consists of three tubes.

6. The multi-container fluid spray device of claim 2, wherein the plurality of nozzle ends consists of three nozzle ends.

7. The multi-container fluid spray device of claim 1, wherein each of the plurality of reversibly connectable containers is independently selected from the following list: bottles, tubes, sleeves, flasks, jars, packets, cans, and drums.

8. The multi-container fluid spray device of claim 1, wherein each of the plurality of reversibly connected containers comprises a male notch and a female notch, wherein the male notch of each of the plurality of reversibly connected containers is configured to reversibly insert into the female notch of an adjacent reversibly connected container within the plurality of containers.

9. The multi-container fluid spray device of claim 1, further comprising a spray handle;

a. wherein the spray handle comprises a top end and a bottom end;

b. wherein the top end of the spray handle is in mechanical connection with the spray head;

c. wherein the bottom end of the spray handle is reversibly connected to a container release mechanism.

10. The multi-container fluid spray device of claim 9, wherein the container release mechanism comprises:

a. a container release housing comprising;

i. a plurality of walls;

ii. a lip disposed at the lower edge of the plurality of walls;

iii. a plurality of release bars; and iv. a plurality of release clips; and b. a plurality of push buttons;

i. wherein each of the plurality of push buttons is in mechanical connection with one of the plurality of release bars; and ii. wherein each of the plurality of release bars is in mechanical connection with one of the release clips.

11. The multi-container fluid spray device of claim 10, wherein the container release mechanism further comprises a spring-loaded mechanism.

12. The multi-container fluid spray device of claim 10, wherein the plurality of push buttons consists of three push-buttons.

13. The multi-container fluid spray device of claim 1, wherein at least one of the plurality of containers is disposable, replaceable, biodegradable, or refillable.

14. The multi-container fluid spray device of claim 1, wherein the spray head further comprises:

a. a front side, and b. a fluid dispenser disposed on the front side, wherein the fluid dispenser comprises a plurality of orifices, and wherein each of the plurality of nozzle ends is in fluid communication with one of the plurality of orifices.

15. The multi-container fluid spray device of claim 1, further comprising a trigger pump actuator arm, wherein the trigger pump actuator arm mechanically connects the single trigger to one of the plurality of pumps.

16. The multi-container fluid spray device of claim 15, wherein the one of the plurality of pumps is disposed in a central position relative to a remainder of the plurality of pumps.

17. The multi-container fluid spray device of claim 1, further comprising a connector in mechanical connection with both the selector switch arm and the rotatable pump carriage, and wherein the connector extends perpendicularly from the selector switch arm from a selector switch pivot point disposed on the selector switch arm.

18. The multi-container fluid spray device of claim 17, further comprising a pump carriage pivot axle which extends from the pump carriage, and which is in mechanical connection with the connector.

19. The multi-container fluid spray device of claim 1, wherein the pump carriage comprises an arc-shaped housing.

20. The multi-container fluid spray device of claim 1, wherein the spray head comprises a top side, and wherein the moveable selector switch indicator is disposed on the top side of the spray head.

* * * * *